US005501369A

United States Patent [19]

Tal

[11] Patent Number: 5,501,369

[45] Date of Patent: Mar. 26, 1996

[54] DEVICE FOR SQUEEZING THE CONTENTS OF FLEXIBLE TUBES

[76] Inventor: Zeev Tal, 15 Ha'assif Street, Haifa 34637, Israel

[21] Appl. No.: 397,580

[22] Filed: Mar. 2, 1995

[51] Int. Cl.[6] ..... B65D 35/28

[52] U.S. Cl. ..... 222/103

[58] Field of Search ..... 222/95, 103

[56] References Cited

U.S. PATENT DOCUMENTS

| | | | |
|---|---|---|---|
| 2,390,314 | 12/1945 | Massey | 222/103 |
| 2,554,975 | 5/1951 | Bendick | 222/95 |
| 3,248,012 | 4/1966 | Adams | 222/95 |
| 4,159,787 | 7/1979 | Wright | 222/103 |
| 4,778,082 | 10/1988 | Vitelle | 222/95 |
| 4,928,851 | 5/1990 | Eatherly | 222/103 |
| 5,222,629 | 6/1993 | Tal | 222/103 |

FOREIGN PATENT DOCUMENTS

| | | | |
|---|---|---|---|
| 3318690 | 11/1984 | Germany . | |
| 4004076 | 9/1991 | Germany | 222/103 |
| 506861 | 12/1954 | Italy | 222/103 |
| 1291228 | 10/1972 | United Kingdom . | |

*Primary Examiner*—Kevin P. Shaver
*Attorney, Agent, or Firm*—William S. Frommer

[57] ABSTRACT

A device for squeezing out a desired quantity of pasty contents from a collapsible tube. Two elongated members connected by a frame are provided with at least one resilient tongue disposed therebetween. The tongue is a U-shaped leaf spring having one side integrally attached to a respective elongated member and another side being free. An opening is provided between the two tongues (or between the tongue and the other elongated member) with this opening narrowing gradually from a relatively wide entrance through which the sealed end of the tube is inserted to a narrow slot which exerts a pressure on the walls of the tube while the device slides on the tube. A slot, and more particularly the tongue(s) exerts a constant force on the flattened walls of the tube to prevent the contents of the tube from escaping through the slot into that portion of the tube which has been emptied.

17 Claims, 3 Drawing Sheets

FIG. 1
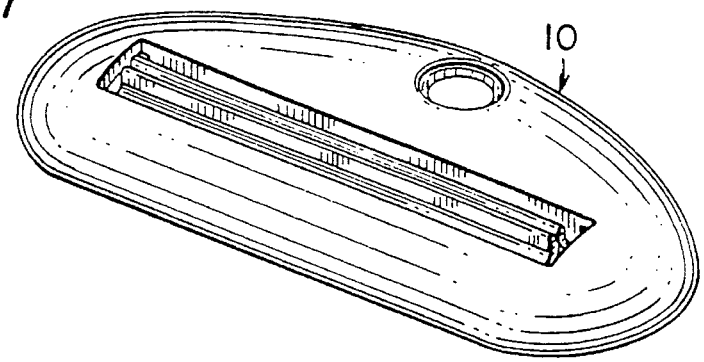
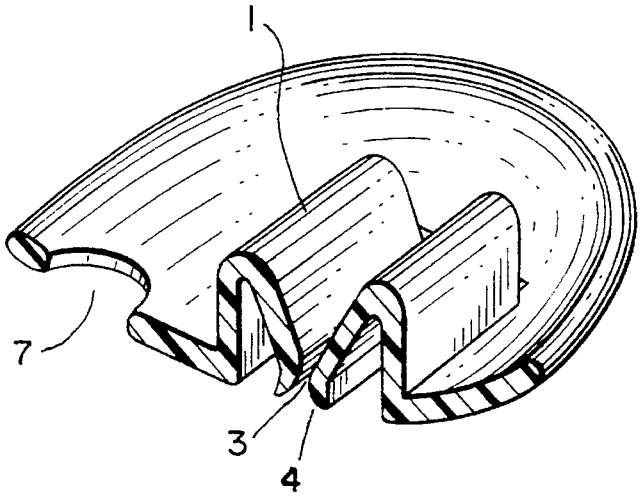
FIG. 2
FIG. 3
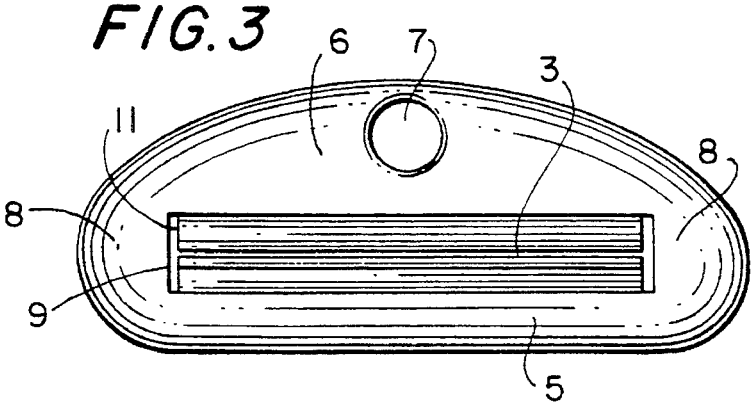

DEVICE FOR SQUEEZING THE CONTENTS OF FLEXIBLE TUBES

FIELD OF THE INVENTION

The present invention relates to a device intended to facilitate the manual squeezing out of the content of a flexible tube of the type used for toothpaste, certain cosmetic preparations, gels, pasty food products and the like. Desired quantities can be squeezed out and the backward flow of the remaining content of the tube can be prevented.

BACKGROUND OF THE INVENTION

The manual squeezing out of the content of flexible tubes is an every-day operation carried out nearly in every household, a representative example being the squeezing out of a desired quantity of toothpaste from a flexible metal or plastic tube. Other examples are tubes containing various cosmetic products, hair treating preparations, shoe cream, etc. Further examples are tubes containing pasty food products like mayonnaise, ketchup, etc. One of the problems in this connection is the backward flow of the remaining content of the tube, another is that it is difficult to squeeze out the entire content of the tube, causing waste.

Various auxiliary devices are known, such as, for example, the device disclosed in U.S. Pat. No. 4,778,082, which has a constant width gap through which the tube is moved, and which is thus not fully effective in squeezing out the entire content of the tube. This prior art device has a constant gap through which the thick rear end of the tube is passed, or it has such a narrow end that the rear end of the tube has to be cut off before insertion. This is apt to cause spilling of the tube content.

Another device is disclosed in U.S. Pat. No. 4,159,787. U.S. Pat. No. 2,390,314 discloses a device comprising two pressure plates, which may be slit to form tongues, said pressure plates are distanced and attached to a trough, a slot being cut in the bottom of said trough, through which slot the collapsed part of the tube may pass.

German published Application No. 33,18,690 discloses a device comprising, attached to holder part, a rigid clamping jaw and a rigid movable pressure plate, held together by two side pieces and a front piece, said clamping jaw and pressure plate defining a slot through which the collapsed part of the tube passes. In one embodiment said pressure plate can be swiveled about an axis and returned by a separate spring and in a second embodiment it is elastically connected by an adhesively attached elastomeric plate to said front piece. This device is not unitary, but composed of a number of separate parts.

British Patent Specification No. 1,291,228 discloses a a collapsible tube carrying a frame which can be slid along the tube towards the open end, with portions of the frame urging the opposite walls of the tube towards each other, forcing out the content of the tube.

Israel Patent No. 95,667 discloses device for removing the content of a flexible tube which comprises an integral structure including two elongated members at least one of which is resilient, connected by a frame at both pairs of corresponding ends thereof or at one pair of corresponding ends thereof. This device has several drawbacks which will be discussed hereafter in connection with the device of the present invention.

The prior art devices are not completely efficient as they do not remove essentially the entire content of the tube, they do not fully prevent the backward flow of the remaining content of the tube, or they are difficult to mount on the tube or be removed therefrom. Other drawbacks of prior art devices will become apparent from the following description.

SUMMARY OF THE INVENTION

The present invention relates to a device for squeezing out a desired quantity of pasty contents of a flexible or collapsible tube comprising an integral structure having two elongated members connected by a frame at both pairs of corresponding ends thereof, at least one of said elongated member having a resilient tongue integrally attached to its free elongate side not connected to the frame, said resilient tongue being a folded U-shaped leaf spring, one side of the leaf spring being integrally attached to the said free elongate side of said elongated member, the other side of the leaf spring being free, said free elongate side of the elongated member and said resilient tongue, or said two resilient tongues in case the two said elongated members have resilient tongues attached thereto, defining an opening which narrows gradually from a relatively wide entrance, the width of which entrance being correlated to the thickness of the rear end of the tube, through which the sealed end of the tube is inserted, to a narrow slot, the width of the slot being correlated to the double wall thickness of the tube, exerting a pressure on the walls of the tube and flattening the same whilst sliding thereon and a constant force on the pressed together flattened walls of the tube holding the walls of the part of the tube engaged by said slot firmly closed, thus separating between the front full part and rear emptied part of the tube and preventing escape of the contents of the tube backwards and also preventing any unwanted sliding of the device along the tube, said resilient tongue/s pressing the walls of the tube together, whereby a desired quantity of the contents of the tube is squeezed out of the tube in the conventional manner by pressing the walls of said front full part of the tube together or by pushing the device toward the front full part of the tube.

In preferred embodiments of the device according to the invention both said elongated members have said resilient tongue integrally attached thereto.

BRIEF DESCRIPTION OF THE FIGURES

FIG. 1 is a top isometric view of a device according to the present invention;

FIG. 2 is an isometric bottom view of half of the device of FIG. 1;

FIG. 3 is a top view of the device of FIG. 1;

DETAILED DESCRIPTION OF THE INVENTION

Figure 4:
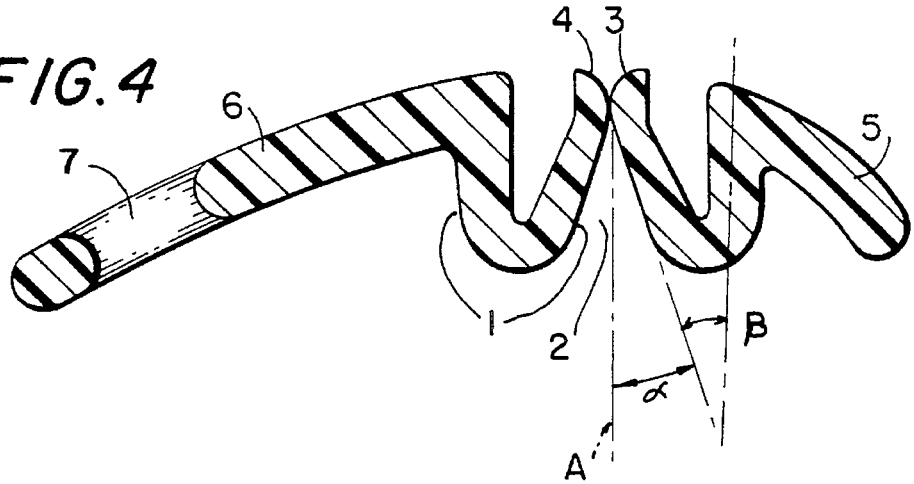
FIG. 4 is a center cross-section of the device of FIG. 1.

The present invention relates to a device for squeezing out a desired quantity of pasty contents of a flexible or collapsible tube comprising an integral structure having two elongated members connected by a frame at both pairs of corresponding ends thereof, at least one of said elongated member having a resilient tongue integrally attached to its free elongate side not connected to the frame, said resilient tongue being a folded U-shaped leaf spring, ne side of the leaf spring being integrally attached to the said free elongate side of said elongated member, the other side of the leaf spring being free, said free elongate side of the elongated member and said resilient tongue, or said two resilient tongues in case the two said elongated members have resilient tongues attached thereto, defining an opening which narrows gradually from a relatively wide entrance, the width of which entrance being correlated to the thickness of the rear end of the tube, through which the sealed end of the tube is inserted, to a narrow slot, the width of the slot being correlated to the double wall thickness of the tube, exerting a pressure on the walls of the tube and flattening the same whilst sliding thereon and a constant force on the pressed together flattened walls of the tube holding the walls of the part of the tube engaged by said slot firmly closed, thus separating between the front full part and rear emptied part of the tube and preventing escape of the contents of the tube backwards and also preventing any unwanted sliding of the device along the tube, said resilient tongue/s pressing the walls of the tube together, whereby a desired quantity of the contents of the tube is squeezed out of the tube in the conventional manner by pressing the walls of said front full part of the tube together or by pushing the device toward the front full part of the tube.

Squeezing devices of the kind of the invention should be capable of providing the pressure required for flattening the opposite walls of the tube to be squeezed, as well as the constant force required to press the flattened walls of the tube over any period of time. The pressure creates friction with the flattened wall of the tube in such a manner that pressing the still full part of the tube, to squeeze out a desired quantity of the contents would not cause the device to slide backward. In addition, the device should be so structured as to allow the thick rear end of the tube to be inserted thereinto. The rear end of the tube is thick either because it is welded, as in plastic tubes, or because it is folded, as in metal tubes. In addition, it should be possible to remove the squeezing device when the tube is empty, for repeated use.

The thick rear end of the tube may be four or more times thicker than the thickness of the pressed walls of the tube itself. This means that when mounting the squeezing device on the tube, a high deflection of its resilient members, in the present invention the resilient tongue, relative to their length is required. Such deflection causes a high strain over the cross-section of the tongue, and therefore a rapid deterioration of the inner stresses, and, in consequence, a smaller clamping force over the tube. In order for the device to function for multiple uses and over long periods of time, it is essential that the force exerted on the walls of the tube remains high, and more or less constant. In order to maintain a high pressing force it is essential that the inner stresses within the preferred plastic material from which the device is made remain constant, without strain relaxation or reduction of the apparent creep modulus or flexural modulus or decrease in the planned pressing forces.

Two families of plastics materials may be contemplated as suitable for devices of the kind of the invention, namely crystalline or amorphous. Within these two families it is possible to observe specific properties such as creeping or inner stress relaxation.

The device according to the present invention combines structural design with choosing a suitable material. Suitable materials should have better creeping properties, and thus amorphous materials are superior to crystalline materials. However, cost, appearance and durability are also factors which should be accounted for.

The geometric design should solve the problems presented by the material, considering the pressure required for flattening the walls of the tube, keeping the pasty contents at the front part of the tube, preventing unwanted sliding of the device over the tube and enabling easy mounting and dismounting over the thick rear end of the tube.

In order to fulfill the requirement of high deflection, but minimal strains, the resilient parts should be as thin and as long as possible. On the other hand, since the device is manufactured by injection molding techniques, its thickness, including the outer frame, should be as uniform as possible. Additionally, it is desirable that the frame which integrates the resilient tongues should also act like a spring and thus reduce the strains and stresses in the resilient parts themselves. Uniform thickness of the device also enables to reduce warpage, in order to ensure that the elongated members, and the resilient tongues are substantially parallel and also to shorten the overall injection time and reduce cost of the product.

Fulfilling the above requirements enables to use materials which are cheaper commodity plastics and not necessarily the more expensive engineering plastics.

Since prior art devices do not fulfill these requirements, the inventor has now developed the device of the present invention. In the presently claimed device the thickness of the frame is as close as possible to the thickness of the resilient tongues. The resilient tongues are preferably U-shaped-folded leaf springs. This provides for relatively very long tongues which practically require little space and do not abutt from the frame, due to the folding. The high length of these tongues provides for high flexibility, small strains and long durability. The frame also has spring-like properties, reducing the stressess on the tongues. In addition, the frame has a relatively large area, which may be used for advertising purposes. It may be noted that the overall frame structure may have an ornamentally designed configuration, for example a toy-like configuration, which will make it attractive for children. The height of the whole device is minimal, and it can thus be accomodated within the tube box.

FIGS. 1 to 4 depict one embodiment of a device according to the invention (10), which comprises a plastic substantially half-circular integral structure which comprises two elongated members (5,6), which extend into resilient flexible members (1). In the embodiment of FIGS. 1 to 4 the resilient members are U-shaped leaf springs. The U-shaped leaf springs define an opening which narrows gradually from the wide entrance port (2), to a narrow slot (3). As may be seen in FIGS. 2 and 4 the free ends of the leaf springs may then gradually diverge from one another to form a wider exit (4). This facilitates the removal of the device from the tube. The resilient members (1) extend along the width of slot (3) and are integral with the elongated members (5, 6), which are part of the overall structure (10). The members (5,6) are integral with the connecting frame (8). Slot (11) between the end of the leaf springs and the sides of the connecting frame (9) enables a flexible movement of the leaf springs. When in use, the rear end of the tube is forced through the slot with the wide opening pointing to the rear part of the tube. By squeezing the walls of the tube a desired quantity of its content is squeezed out, with the flexible members (1) exerting adequate pressure on the walls of the tube to prevent its backward movement and also any movement backwards of the tube content. As may be seen from the figures, in the illustrated preferred embodiments the resilient members are U-shaped folded leaf spring. In particularly preferred embodiments the arm of the U-shaped leaf spring integrally attached to said elongated member forms an acute angle β with the other, free arm thereof and this angle β is substantially equal to the acute angle α between the free arm of the U-shaped leaf spring and the central axis of the opening (A). In the depicted embodiment the outer surfaces of the leaf springs are curved. It is evident that these outer surfaces can also be planar.

Figure 5:
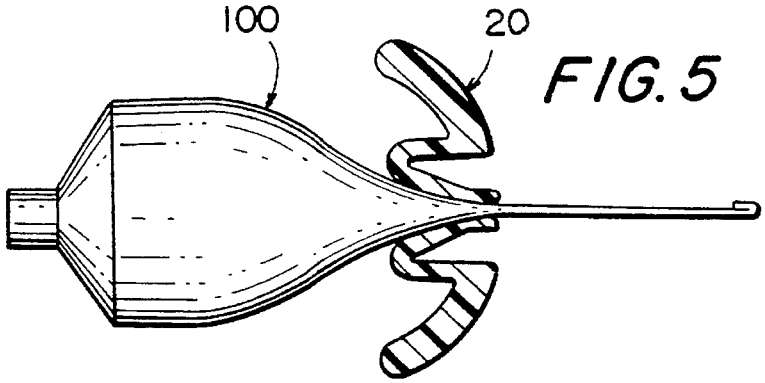
FIG. 5 is cross-sectional view of an assembly of a paste tube and a second embodiment of a device according to the present invention.
Figure 6:
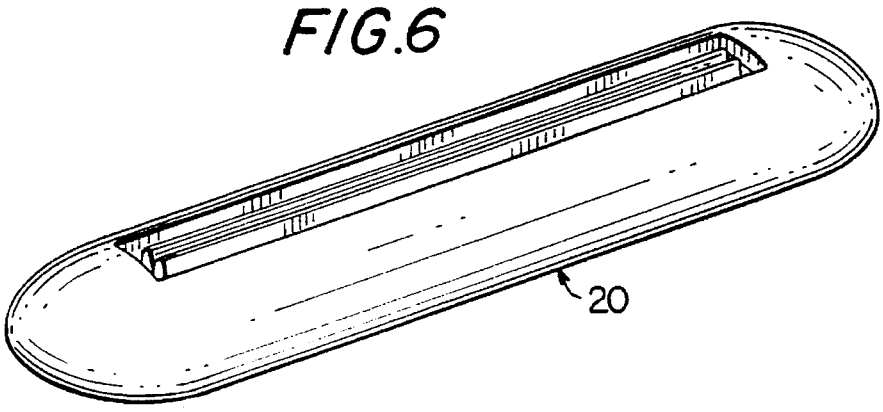
FIG. 6 is a top isometric view of the device of FIG. 5.
Figure 7:
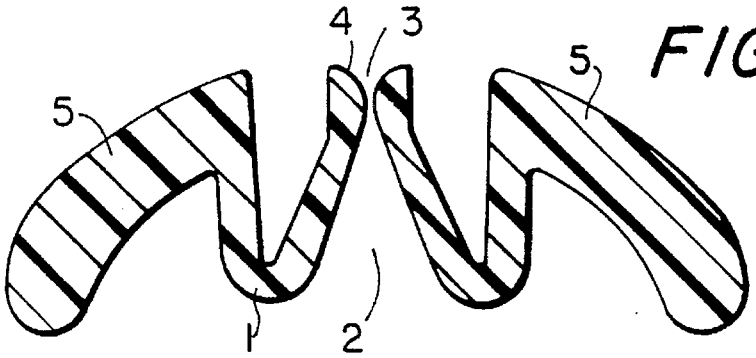
FIG. 7 is a center cross-section of the device of FIG. 6.
Figure 8:
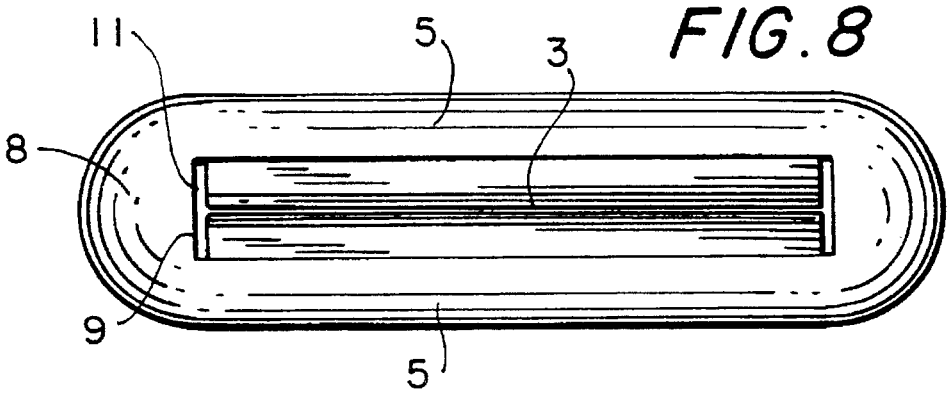
FIG. 8 is a top view of the device of FIG. 6.

FIGS. 5 to 8 illustrate another embodiment of a device according to the present invention, in which the the overall structure (10) is symmetrical, and therefore the whole device may be of smaller size. A small size is desired when the device is to be packed in a box, together with the paste tube. With a small size a bigger box would not be required and no damage may occur to either the paste tube or the box. In FIGS. 5 to 8 identical parts are designated by identical numerals. In FIG. 5, a tube (100) is shown with a device according to the invention thereon.

Figure 9:
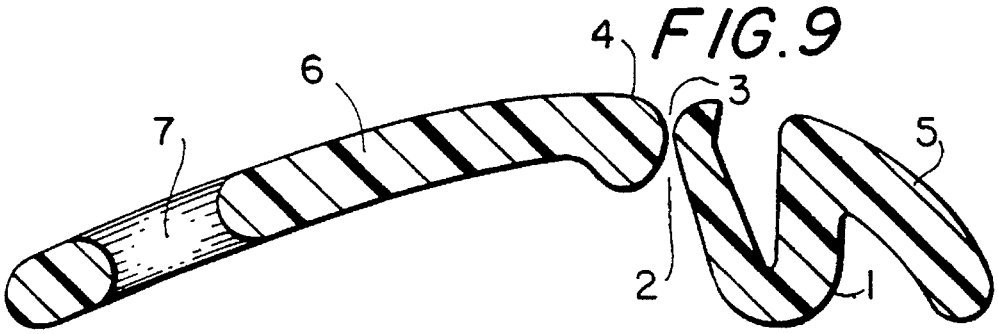
FIG. 9 is a cross-sectional view of a further embodiment of a device according to the invention.

FIG. 9 illustrates a further embodiment of the device according to the present invention. In the device of FIG. 9 only one of the elongated members (5) has a U-shaped leaf spring integrally attached thereto. The other elongated member (6) is rigid. In this particular embodiment, the face of the rigid elongated member (6) facing the exit (4) is curved. Needless to say, the U-shaped leaf spring may alternatively be integrally attached to elongated member (6), with member (5) being rigid.

The device according to the present invention can be made from suitable plastics materials. Preferred plastics materials are amorphous plastic material such as ABS and ABS alloys, SAN, acrylics, high impact polystyrenes and polycarbonates. Other specific plastics materials may be suitable, as known to the man of the art.

The various embodiments of the device according to the present invention may be provided with means for suspension from suitable support means on a wall or, alternatively, with integral means for affixing the same to a wall. For example, as may be seen in FIGS. 1 to 4 and 9, the frame member may be provided with an opening (7), by which the device may be hung on a suitable hook, affixed to a wall or the like. The friction between the resilient tongues and the tube prevents the relatively heavy tube from sliding out of the device when hanging vertically, the full front part of the tube facing downwards.

While few specific embodiments have been described in detail, the invention is not limited thereto and is only defined by the scope of the appended claims.

I claim:

1. A device for squeezing out a desired quantity of pasty contents of a flexible or collapsible tube having sealed end, said device comprising an integral structure having two elongated members connected by a frame, each of said elongated members having a free elongate side to which a resilient tongue is integrally attached, said resilient tongue being a U-shaped leaf spring having one side integrally attached to said free elongate side of a respective elongated member and another being free, said resilient tongues defining an opening which narrows gradually from a relatively wide entrance, the width of which entrance being correlated to the thickness of the rear end of the tube, through which the sealed end of the tube is inserted, to a narrow slot whose width is correlated to the double wall thickness of the tube, said resilient tongues exerting a pressure on the walls of the tube and flattening the same whilst sliding thereon and also exerting a constant force on the pressed together flattened walls of the tube holding the walls of that part of the tube engaged by said slot firmly closed, thus separating between a front of the tube which is full and a rear part of the tube which is emptied and preventing escape of the contents of the tube backwards and also preventing unwanted sliding of the device along the tube, said resilient tongues pressing the walls of the tube together, whereby a desired quantity of the contents of the tube is squeezed out of the tube by pressing the walls of said front full part of the tube together or by pushing the device toward the front full part of the tube.

2. A device according to claim 1 wherein the U-shaped spring leaf includes a free arm and an arm that is integrally attached to said respective elongated member to form between said arms an angle β smaller than 45°, said angle β being substantially equal to an acute angle α between said free arm of the U-shaped spring leaf and a central axis of said opening.

3. A device according to claim 2 wherein said angle β is from 8° to 45°.

4. A device according to claim 1 wherein the free side of said U-shaped leaf springs gradually diverge away from one another to form a wider exit, thereby facilitating removal of the device from the tube.

5. A device according to claim 1 wherein said U-shaped leaf spring have planar surfaces.

6. A device according to claim 1 wherein said U-shaped leaf spring have curved surfaces.

7. A device according to claim 1 wherein said U-shaped leaf spring is of uniform thickness.

8. A device according to claim 1 wherein said U-shaped leaf spring has a thickness that is greater at the side connected to said elongated member and gradually decreases toward said free side of the leaf spring.

9. A device according to claim 1 further including means for suspending said elongated member from a support means on a wall.

10. A device according to claim 1 wherein said frame is substantially oval.

11. A device according claim 1 wherein said frame is substantially half-circular.

12. A device according to claim 1 wherein said frame has an ornamentally designed configuration.

13. A device according to claim 1 further comprising integral means for affixing the device to a wall.

14. A device according to claim 1 wherein said frame includes outer surfaces configured to facilitate gripping thereof by a user's fingers.

15. A device according to claim 1 made from plastic material.

16. A device for squeezing out a desired quantity of pasty contents of a flexible or collapsible tube having a sealed end, said device comprising an integral structure having two elongated members connected by a frame, one of said elongated members having a free elongate side to which a resilient tongue is integrally attached, said resilient tongue being a U-shaped leaf spring having one side integrally attached to said free elongated side of said one elongated member and another side being free, the other of said elongated members having a free elongate side which defines an opening with said free side of said resilient tongue, said opening narrowing gradually from a relatively wide entrance whose width is correlated to the thickness of the rear end of the tube, through which the sealed end of the tube is inserted, to a narrow slot whose width is correlated to the double wall thickness of the tube, said resilient tongue exerting a pressure on the walls of the tube and flattening same whilst sliding thereon and also exerting constant force on the pressed together flattened walls of the tube holding the walls of that part of the tube engaged by said slot firmly closed, thus separating between a front part of the tube which is full and a rear part of the tube which is emptied and preventing escape of the contents of the tube backwards and also preventing unwanted sliding of the device along the tube, said resilient tongue pressing the walls of the tube together, whereby a desired quantity of the contents of the tube is squeezed out of the tube by pressing the walls of said front full part of the tube together or by pushing the device toward the front full part of the tube.

17. A device according to claim 16 wherein said other elongated member having a free side is rigid.

* * * * *